US005544964A

United States Patent [19]

Yoshida et al.

[11] Patent Number: 5,544,964

[45] Date of Patent: Aug. 13, 1996

[54] DOT LINE PRINTER HAVING A BALANCE SHUTTLE

[75] Inventors: Yuichi Yoshida; Hitoshi Moriyama, both of Kawasaki, Japan

[73] Assignee: Fujitsu Limited, Kawasaki, Japan

[21] Appl. No.: 487,911

[22] Filed: Jun. 7, 1995

[30] Foreign Application Priority Data

Sep. 6, 1994 [JP] Japan ..... 6-212231

[51] Int. Cl.[6] ..... B41J 19/02

[52] U.S. Cl. ..... 400/322; 400/341; 101/93.08

[58] Field of Search ..... 101/93.08, 93.15; 400/319, 320, 320.1, 322, 323, 341

[56] References Cited

U.S. PATENT DOCUMENTS 4,921,365 5/1990 Sanders, Jr. et al. ..... 400/323

4,941,405 7/1990 Helms ..... 400/323

5,156,474 10/1992 Kurosawa et al. ..... 400/323

*Primary Examiner*—John S. Hilten

*Attorney, Agent, or Firm*—Staas & Halsey

[57] ABSTRACT

Disclosed is a shuttle mechanism of a dot line printer including a printing shuttle unit making a reciprocating motion to perform dot printing and a balance shuttle unit making a motion in a direction opposite to the kinetic motion of the printing shuttle unit. This shuttle mechanism is constructed of a linear motor in which a movable unit for the reciprocating motion and a magnetic circuit are separated. With this construction, the movable unit can be decreased in weight. Therefore, the high-speed reciprocating motion can be made, and high-speed printing is thereby attainable. The balance shuttle unit is disposed under the printing shuttle unit. The apparatus can be thereby made compact.

9 Claims, 9 Drawing Sheets

DOT LINE PRINTER HAVING A BALANCE SHUTTLE

BACKGROUND OF THE INVENTION

1. Field of the Invention

The present invention relates to a dot line printer including a printing unit making a reciprocating motion and a shuttle unit making a motion in a direction opposite thereto.

2. Description of the Related Art

A dot line printer apparatus performs printing while a printing unit makes a rectilinear reciprocating motion. Then, when completing one-line printing, the consecutive printing is carried out by feeding a sheet in a direction orthogonal thereto. This printing unit has a plurality of dot elements and is therefore large in weight. Hence, the apparatus oscillates due to the reciprocating motions of the printing unit.

For preventing this phenomenon, in the apparatus, provided is a shuttle unit making a motion in a direction opposite to that of the printing unit. The motion of this shuttle unit takes a balance with the motion of the printing unit. The oscillations of the apparatus can be thereby prevented. In the dot line printer equipped with the shuttle unit making the motion in this opposite direction, the reciprocating motion is required to increase in terms of velocity.

FIG. 8 is a perspective view showing the prior art. FIG. 9 is a sectional view of the prior art.

As illustrated in FIGS. 8 and 9, a balance shuttle unit 9 is provided in a face-to-face relationship with a printing shuttle unit 8.

The printing shuttle unit 8 includes a printing unit 80 having a plurality of dot printing elements. This printing unit 80 is mounted on a shuttle frame 81 moving along a shuttle shaft 85. The printing unit 80 is constructed such that a plurality of wire dot element strings each having a plurality of vertically arranged wire dot elements are arrayed at a predetermined interval.

Coils 82 are provided under this shuttle frame 81 through a yoke 86. A magnet 84 is attached to a base frame (yoke) 83 in a face-to-face relationship with this coil 82. Note that the numeral 87 designates a guide roller for the reciprocating motion, and 88 represents a balance weight.

On the other hand, the balance shuttle unit 9 has a balance weight unit 90 for taking a balance in terms of weight with the printing unit 80. This balance weight unit 90 is mounted on a shuttle frame 91 moving along a shuttle shaft 95. Coils 92 are provided under this shuttle frame 91 through a yoke 96. A magnet 94 is attached to a base frame (yoke) 93 in the face-to-face relationship with the coils 92. Note that the numeral 97 denotes a guide roller for the reciprocating motion.

This printing mechanism is based on the principle that the printing unit 80 is reciprocated by a linear motor. That is, the shuttle unit 81 to which the coils 82 are fixed makes the reciprocating motion in the direction right-angled to a feeding direction of a sheet 71. With this motion, the wire dot printing elements of the printing unit 80 are driven toward a platen 70, thus effecting the printing on the sheet 71.

According to a kinetic principle of the linear motor, an electric current flows across the coils 82 in a magnetic field generated by a permanent magnet 84 disposed under the coils 82. With this operation, the shuttle unit 81 fitted with the coils 82 makes a motion according to the Fleming's left-hand rule.

On the other hand, the balance shuttle unit 9 makes a motion in a direction opposite to that of the printing shuttle unit 8 on the basis of the same principle as that of the printing shuttle unit 8. This offsets an inertial moment of the printing shuttle unit 8, thereby preventing the oscillations.

An improvement of this printing speed entails a speed-up of the reciprocating motion of the printing unit. For this purpose, there are considered a method of reducing a load on the linear motor by decreasing weights of members for making the reciprocating motion and a method of increasing an output of the linear motor.

The former method requires reductions in weight of the coils 82, 92, the shuttle frames 81, 91 and the coil bases 86, 96. Reducing the weights of the coils 82, 92 leads to down-sizing of the coils 82, 92. However, this brings about a drop of output of the linear motor, and therefore the coils can not be reduced in weight. Further, the shuttle frame 81 is hard to extremely decrease in weight because of bearing a printing reaction and, besides, actualizing the stable reciprocating motion.

Moreover, according to the prior art, the coil bases 86, 96 serves as the yokes. For this reason, the coil base is required to have a minimum plate thickness enough not to saturate a magnetic flux of the magnet. Accordingly, this conduces to a problem in which the weight of the coil base is hard to decrease.

On the other hand, increasing the output of the linear motor involves enlarging the coils or the magnet. Consequently, there arises a problem in which the apparatus augment in size.

Besides, according to the prior art, the printing shuttle unit 8 and the balance shuttle unit 9 are disposed facing each other through the sheet, resulting in such a problem that the size of the apparatus increases.

SUMMARY OF THE INVENTION

It is a primary object of the present invention to provide a dot line printer capable of speeding up a reciprocating motion of a printing unit.

It is another object of the present invention to provide a dot line printer capable of decreasing a movable unit of a reciprocating motion mechanism in weight.

It is still another object of the present invention to provide a dot line printer capable of decreasing a plate thickness of a coil base.

It is a further object of the present invention to provide a dot line printer capable of restraining oscillations due to the reciprocating motion.

It is a still further object of the present invention to provide a dot line printer capable of attaining down-sizing of the apparatus.

To accomplish the objects given above, according to one aspect of the present invention, a dot line printer comprises a printing shuttle unit making a reciprocating motion to perform dot printing and a balance shuttle unit making a motion in a direction opposite to the kinetic direction of the printing shuttle unit. The printing shuttle unit includes a first magnetic circuit having a first magnet and a first yoke that are disposed in a face-to-face relationship and a first coil base plate disposed in a magnetic gap of the first magnetic circuit and provided with first coils. The printing shuttle unit further includes a printing unit having a plurality of dot printing elements, a printing shuttle frame mounted with the printing unit and a pair of first connecting arms for connecting the first coil base plate to the printing shuttle frame. The balance shuttle frame includes a second magnetic circuit having a second magnet and a second yoke that are disposed in the face-to-face relationship, a second coil base plate disposed in a magnetic gap of the second magnetic circuit and provided with second coils and a balance unit for taking a balance with the printing unit. The balance shuttle unit further includes a shuttle frame mounted with the balance unit and a pair of second connecting arms for connecting the second coil base plate to the shuttle frame.

According to the above aspect of the present invention, the coil base plate of the shuttle unit does not function as a yoke. Then, a yoke fixed otherwise is provided. This coil base plate is fitted with a shuttle frame by use of the connecting arms. Therefore, the coil base plate may have a thickness enough to bear the coils. With this construction, the movable unit of the shuttle unit can be reduced in weight. Accordingly, the printing unit is capable of making the high-speed motion, and this leads to the high-speed printing.

Further, according to another aspect of the present invention, a dot line printer for performing dot printing on a sheet comprises a printing shuttle unit making a reciprocating motion to perform the dot printing and a balance shuttle unit provided under the printing shuttle unit and making a motion in a direction opposite to the kinetic direction of the printing shuttle unit.

According to this aspect of the present invention, the balance shuttle unit is provided under the printing shuttle unit, and the apparatus can be therefore made compact. Further, the magnets each undergoing the reaction of the reciprocating motion are disposed close to each other, and, besides, the movable units of the two shuttles are also close to each other. Hence, the oscillations exerted on the apparatus as a whole can be restrained. The high-speed motion can be therefore attained.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DETAILED DESCRIPTION OF THE PREFERRED EMBODIMENTS

Figure 1:
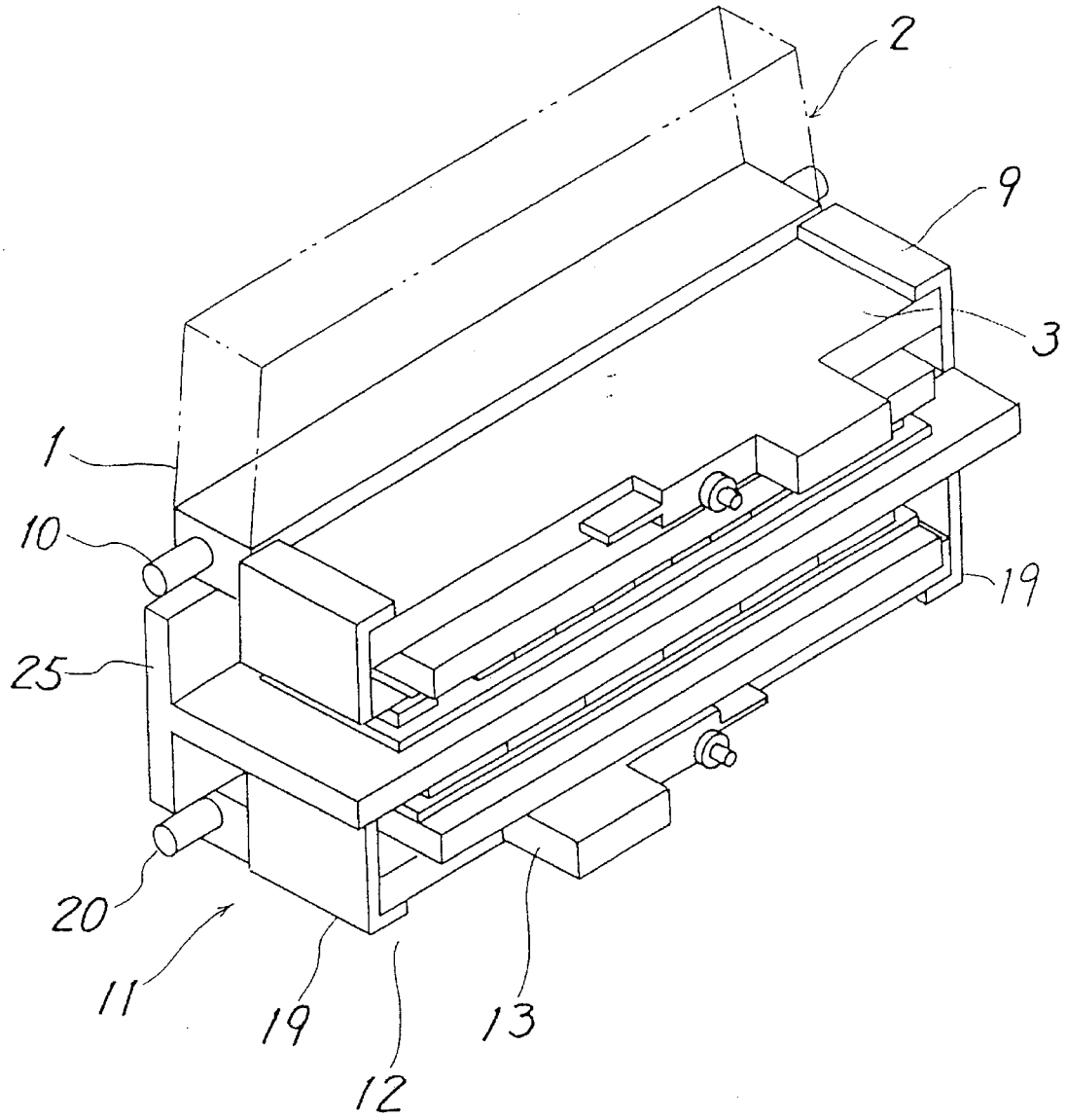
FIG. 1 is a perspective view showing one embodiment of the present invention.
Figure 2:
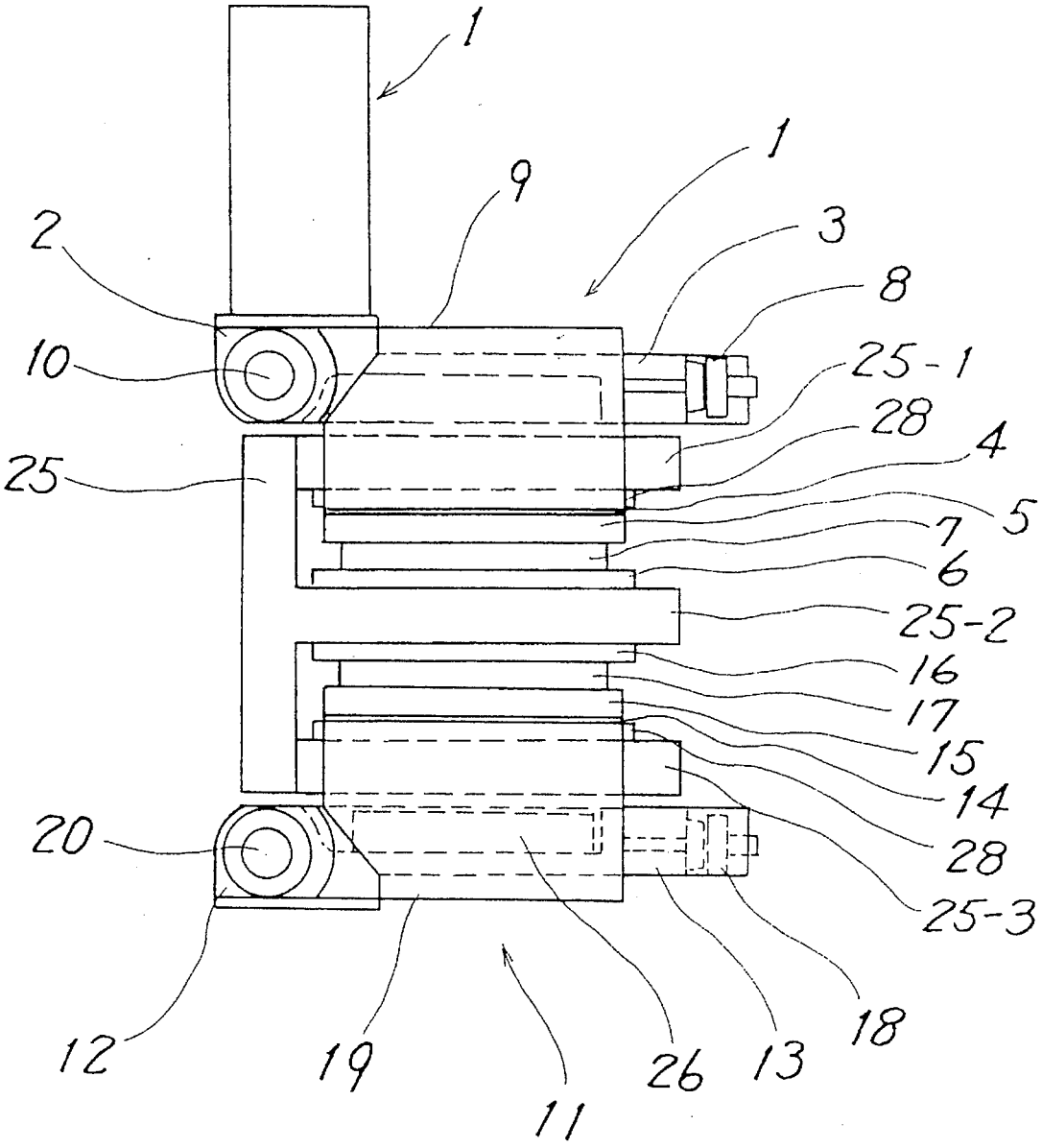
FIG. 2 is a side view of one embodiment of the present invention.
Figure 3:
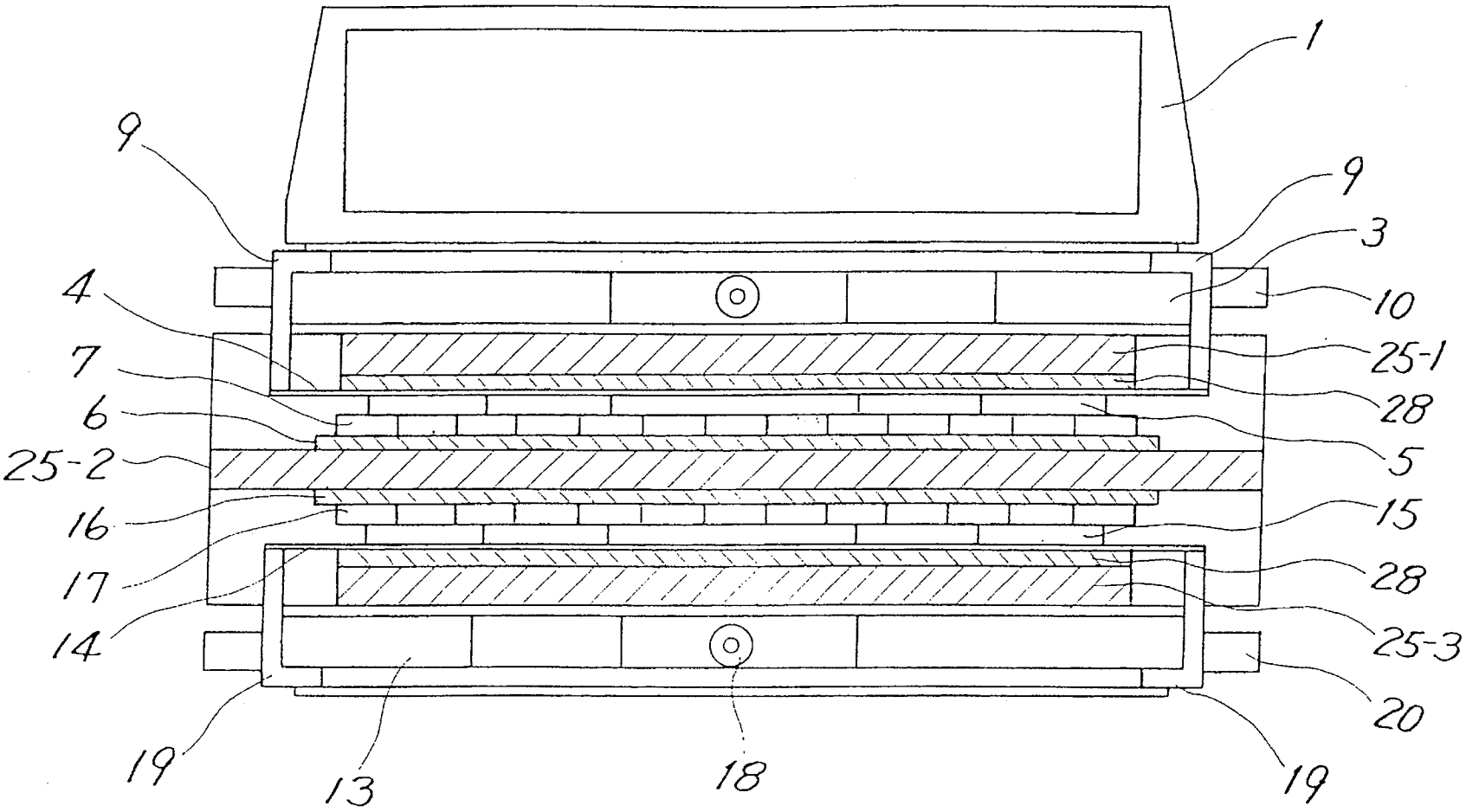
FIG. 3 is a front view of one embodiment of the present invention.
Figure 4:
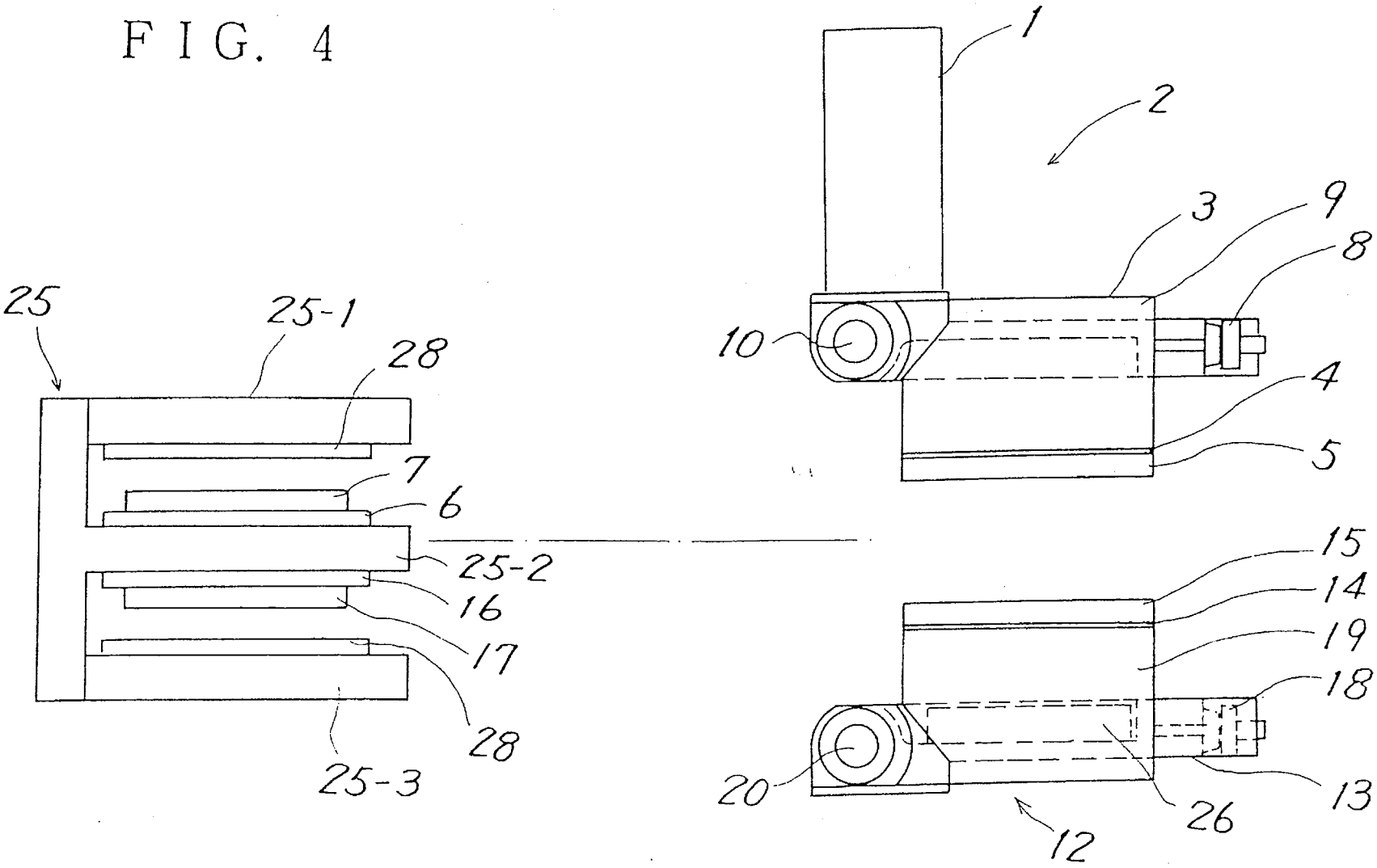
FIG. 4 is a fragmentary view illustrating a shuttle unit of FIG. 2.
Figure 5:
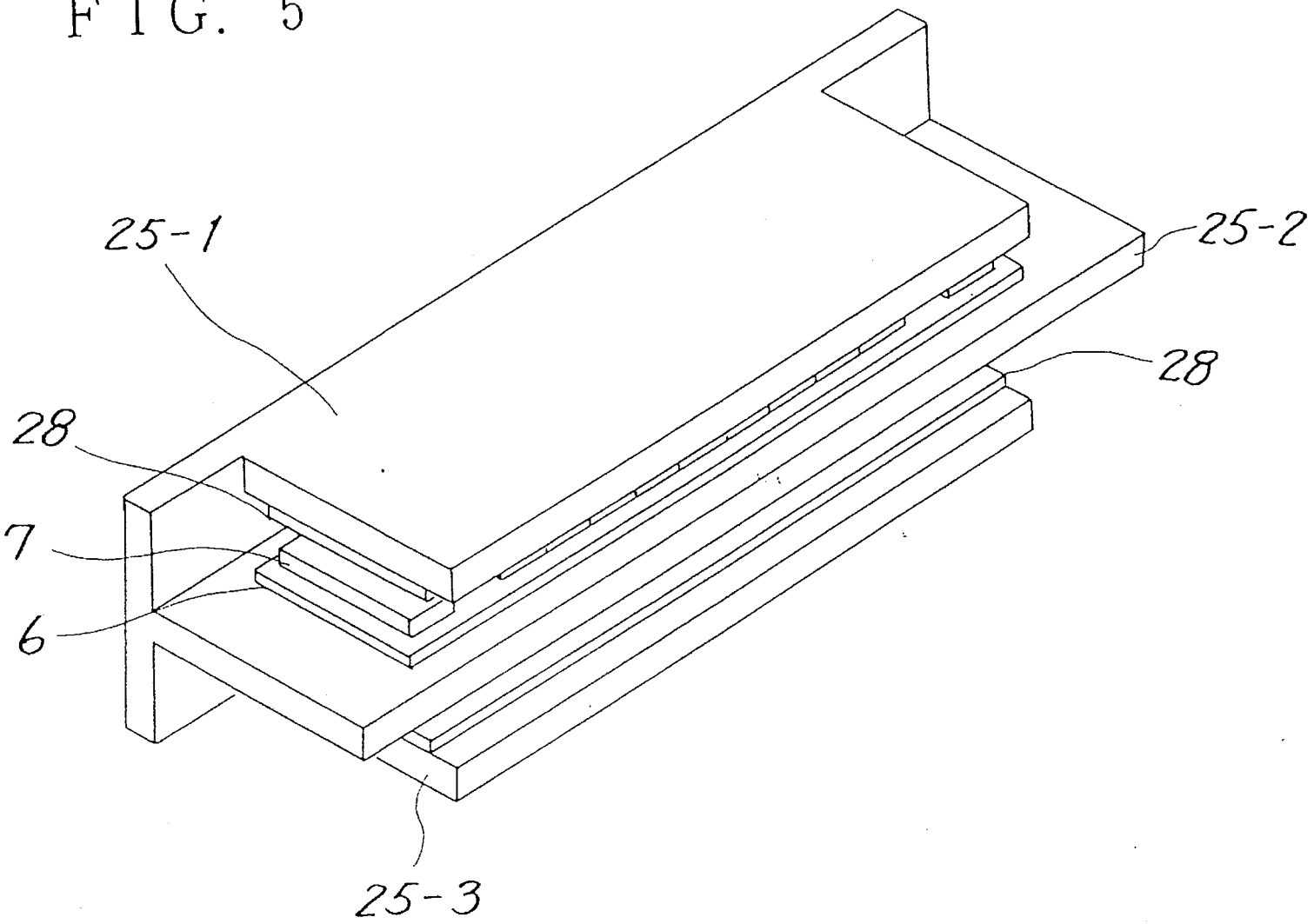
FIG. 5 is a perspective view illustrating a magnetic circuit.
Figure 6:
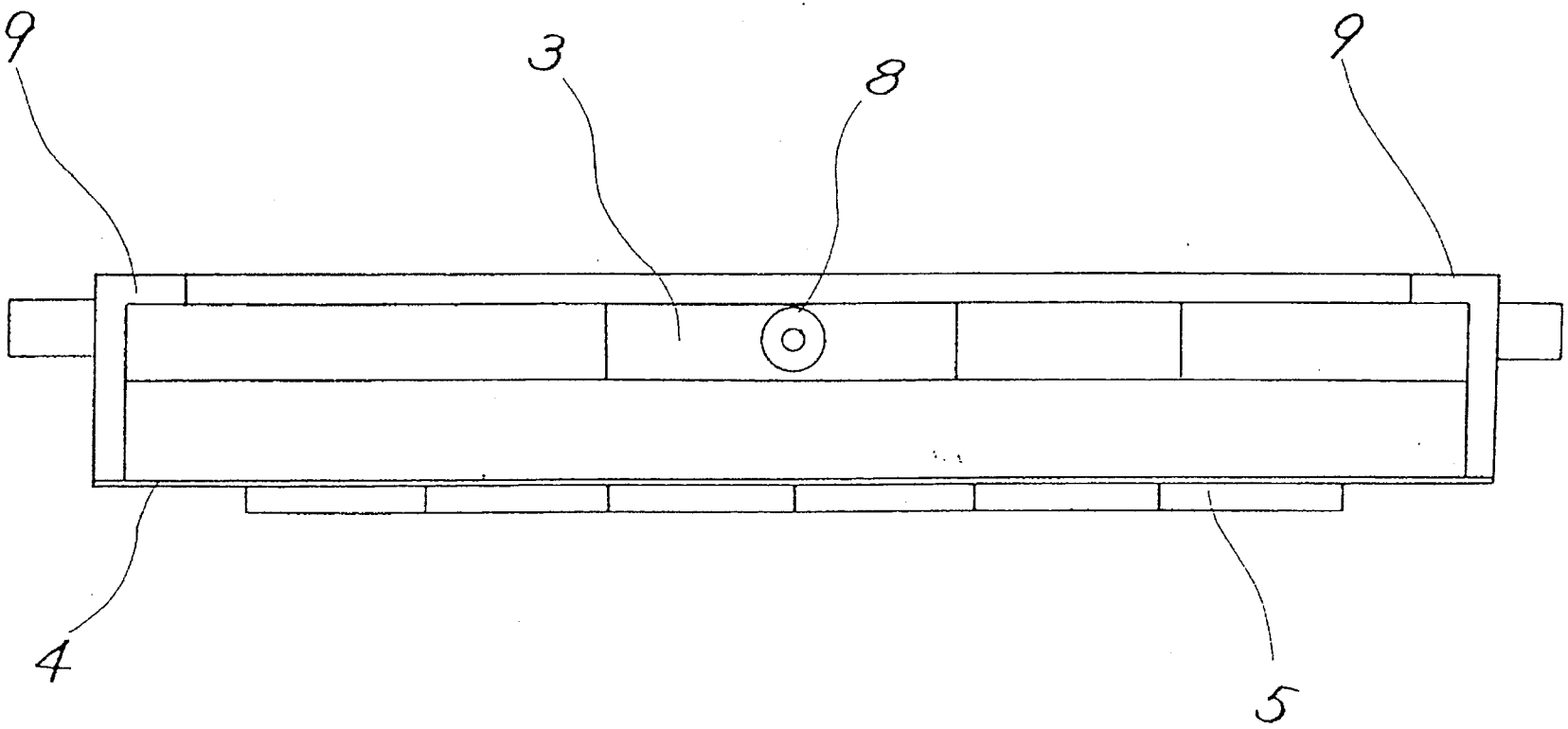
FIG. 6 is a front view showing a printing shuttle frame of FIG. 1.
Figure 7:
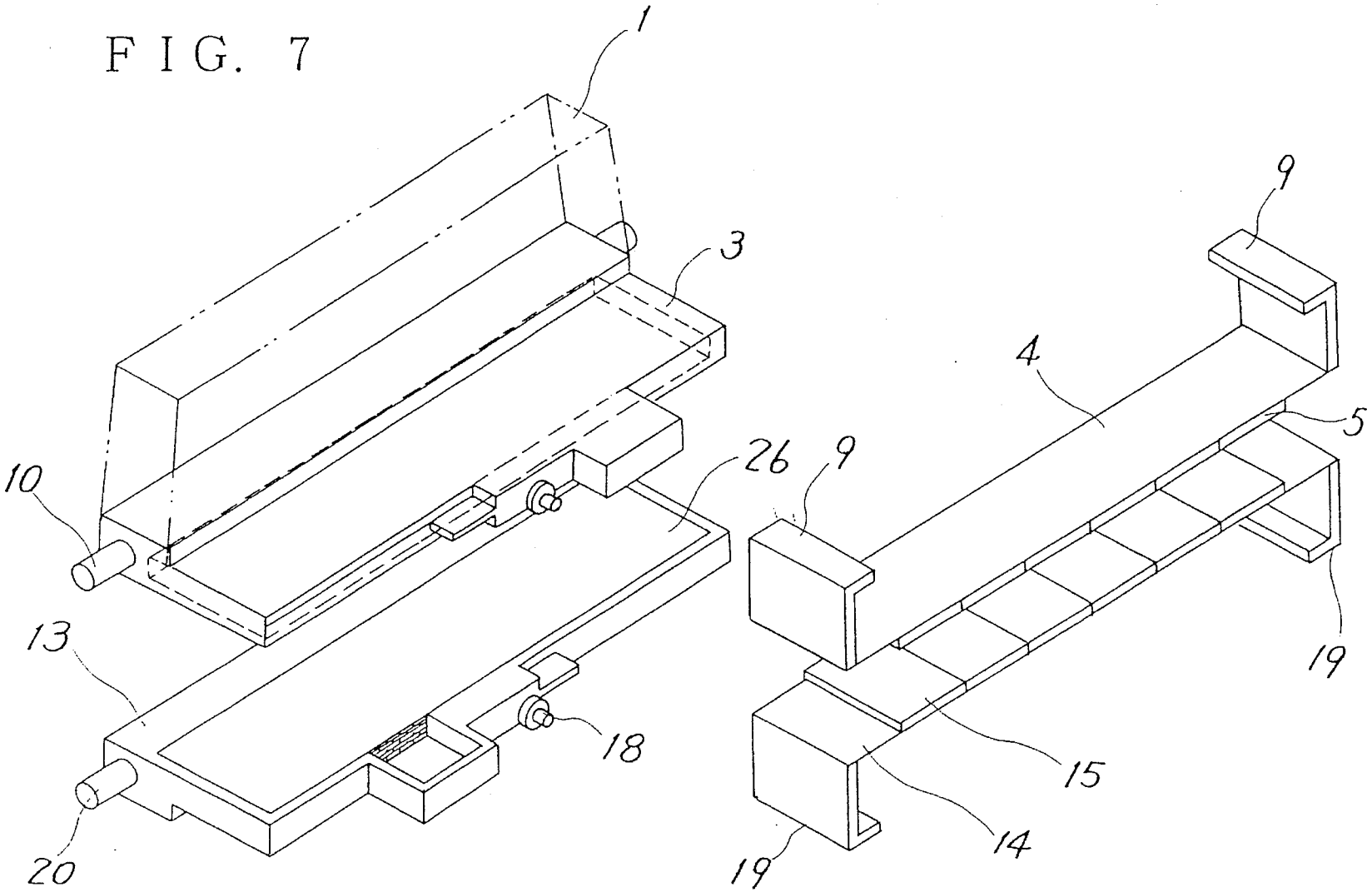
FIG. 7 is a fragmentary perspective view illustrating a shuttle frame of FIG. 2.
Figure 8:
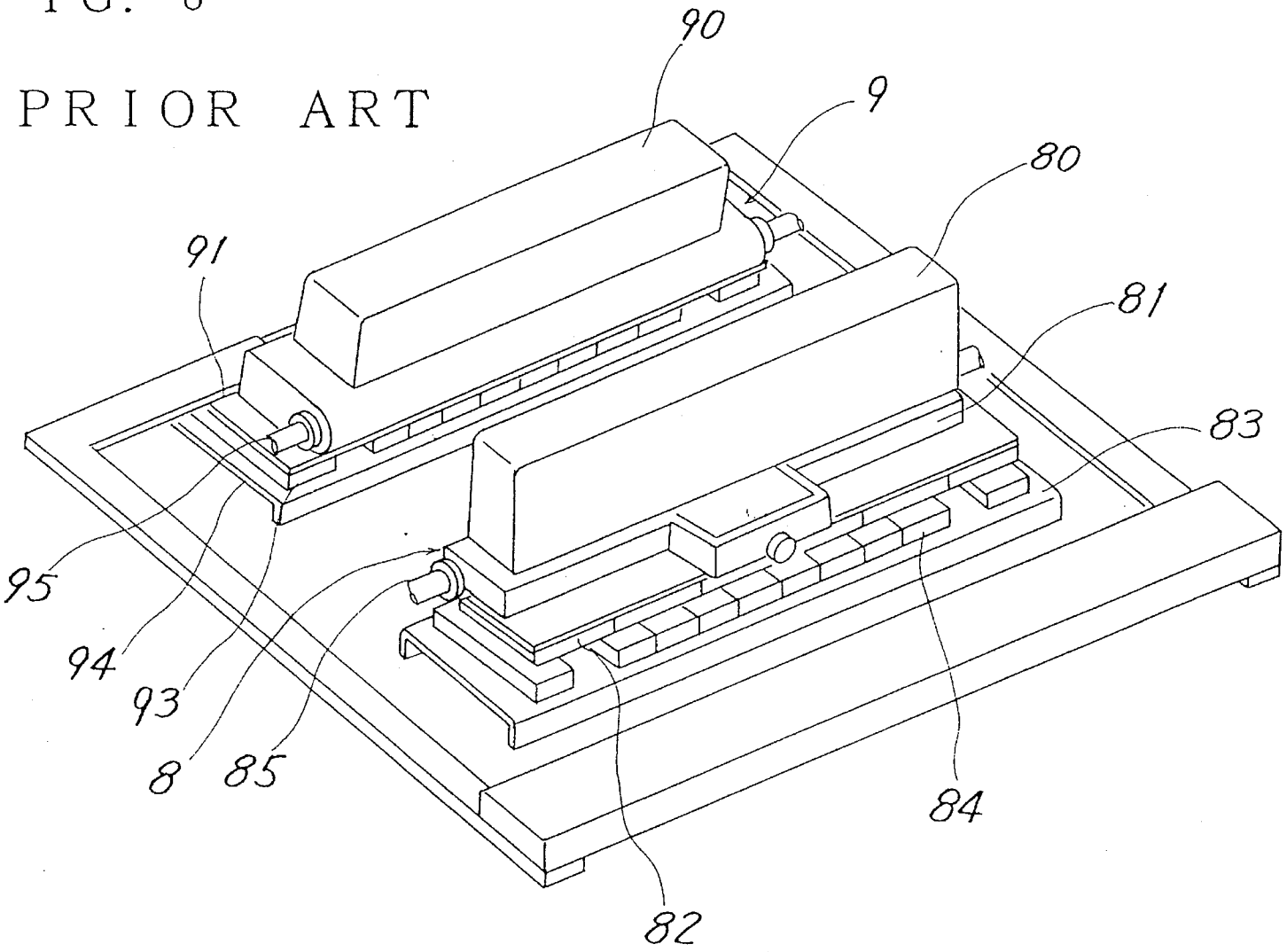
FIG. 8 PRIOR ART
FIG. 8 is a perspective view showing the prior art.
Figure 9:
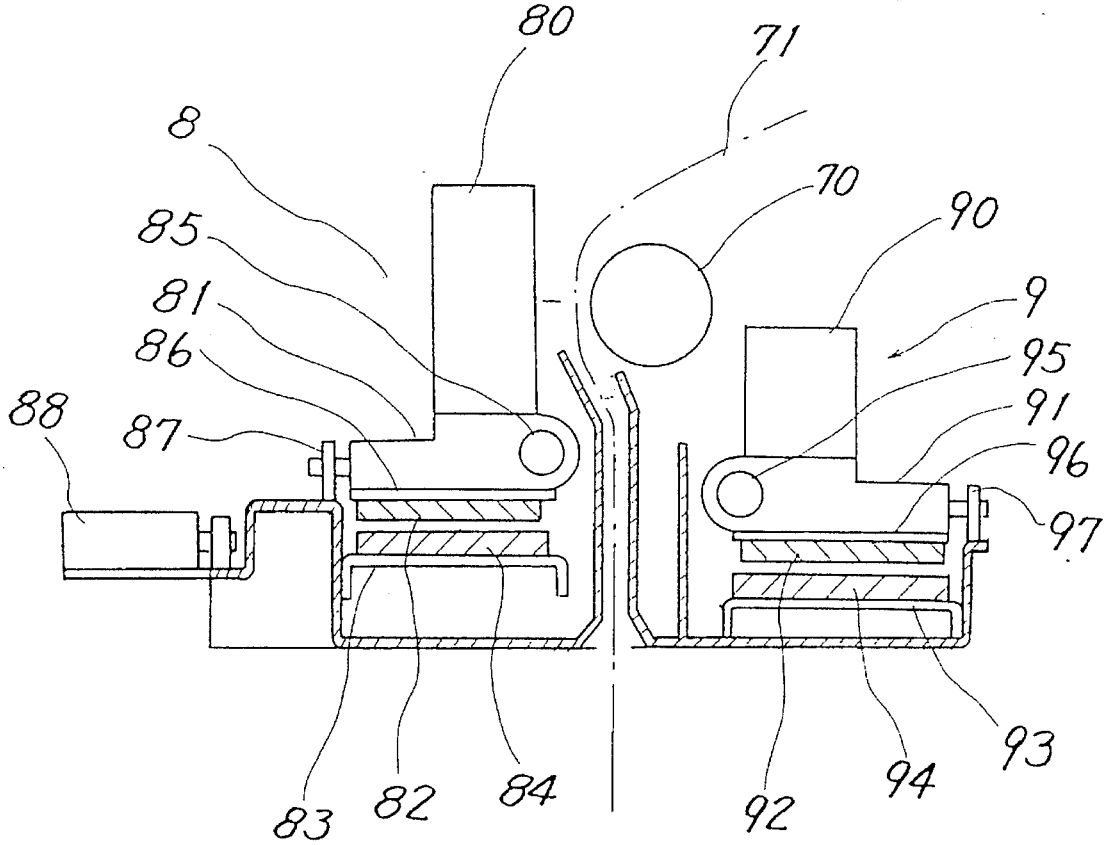
FIG. 9 PRIOR ART
FIG. 9 is a sectional view showing the prior art.

FIG. 1 is a perspective view of one embodiment of the present invention. FIG. 2 is a side view of one embodiment of the present invention. FIG. 3 is a front view of one embodiment of the present invention. FIG. 4 is a fragmentary view illustrating a shuttle unit. FIG. 5 is a perspective view illustrating a magnetic circuit. FIG. 6 is a front view showing a printing shuttle frame of FIG. 1. FIG. 7 is a perspective view illustrating the shuttle frame of FIG. 1.

As illustrated in FIG. 1, a dot line printer is constructed of a printing shuttle unit 2 mounted with a printing unit 1 and a balance shuttle unit 11 provided under this printing shuttle unit 2. This printing unit 1 is equipped with a plurality of dot printing elements. This printing unit 1 is, as known well, constructed such that a plurality of wire dot element strings each having a plurality of wire dot elements arranged in one line are arrayed at a predetermined pitch. And an unillustrated platen is provided in a face-to face relationship with the printing unit 1.

As shown in FIGS. 6 and 7, the printing shuttle unit 2 includes a shuttle frame 3 moving along a shuttle shaft 10, This shuttle frame 3 is mounted with the printing unit 1. Also, the shuttle frame 3 is provided with guide rollers 8 for reciprocating motions. Further, a coil base plate 4 is composed of a light-weight non-magnetic material.

This coil base plate 4 has a multiplicity of coils 5 provided on its rear surface. A pair of connecting arms 9 are fastened to both edges of the coil base plate 4 with screws. These connecting arms 9 are fastened to both edges of the shuttled frame 3 with screws. Accordingly, as illustrated in FIG. 6, the shuttle frame 3, the pair of connecting arms 9 and the coil base plate 4 are combined to constitute a box structure.

On the other hand, the balance shuttle unit 11 includes, as illustrated in FIG. 7, a shuttle frame 13 moving along a shuttle shaft 20. This shuttle frame 13 is mounted with a balance weight unit 26. The shuttle frame 13 is also provided with guide rollers 18 for the reciprocating motions. Further, the coil base plate 14 is a light-weight non-magnetic material.

This coil base plate 14 has a multiplicity of coils 15 provided on its surface. A pair of connecting arms 19 are fastened to both edges of the coil base plate 14 with screws. These connecting arms 19 are fastened to both edges of a shuttle frame 13 with screws. Accordingly, similarly, the shuttle frame 13, the pair of connecting arms 19 and the coil base plate 14 are combined to constitute a box structure.

Next, a structure of the magnetic circuit will be explained. As illustrated in FIGS. 4 and 5, the magnetic circuit includes a holding block 25 taking an E-shape in section. This holding block 25 has an upper arm 25-1, an intermediate arm 25-2 and a lower arm 25-3. Gaps between these arms 25-1, 25-2 and 25-3 are fixed.

A first yoke 28-1 is provided on the lower surface of the upper arm 25-1. A yoke 6 and a first permanent magnet 7 are provided on the upper surface of the intermediate arm 25-2 in a face-to-face relationship with the first yoke 28-1. Further, a yoke 16 and a second permanent magnet 17 are attached to the lower surface of the intermediate arm 25-2. A second yoke 28-2 is attached to the upper surface of the lower arm 25-3 in the face-to-face relationship with the second permanent magnet 17.

As illustrated in FIG. 4, the first arm 25-1 of the holding block 25 is inserted between the shuttle frame 3 of the printing shuttle unit 2 and the coil base plate 4. The second arm 25-2 of the holding block 25 is inserted between the coils 5 of the printing shuttle unit 2 and the coils 15 of the balance shuttle unit 12. The third arm 25-3 of the holding block 25 is inserted between the shuttle frame 13 of the balance shuttle unit 12 and the coil base plate 14.

With this arrangement, the section goes as illustrated in FIG. 2, while the front goes as shown in FIG. 3. That is, in the printing shuttle unit 2, the coils 5 provided on the first coil base plate 4 are positioned in the magnetic gap between the first yoke 28-1 and the first permanent magnet 7. Further, in the balance shuttle unit 12, the coils 15 provided on the second coil base plate 14 are positioned in the magnetic gap between the second yoke 28-2 and the second permanent magnet 17.

Thus, the balance shuttle unit 12 is disposed in a symmetric position of the printing shuttle unit 2 with respect to the holding block 25 of the magnetic circuit. Therefore, a shuttle mechanism hitherto requiring a broad packaging area can be packaged in a compact way. Further, the permanent magnets 7, 17 each undergoing reaction of the reciprocating motion are disposed in close proximity to each other, and, besides, the reciprocating motion parts of the two shuttle units 2, 12 are also close to each other. Oscillations exerted on the apparatus as a whole are thereby restrained. A high-speed motion can be therefore attained.

The two shuttle units 2, 12 include the movable coil units and the magnetic circuits that are separated from each other. Therefore, the movable coil unit can be structured such that the coil base plate is attached to connecting arms at both edges of the shuttle frame, and the coils are fitted onto the coil base plate.

This coil base plate does not serve as a yoke, and hence there is no necessity for providing a yoke having a plate thickness enough not to saturate a magnetic flux of the magnet. Accordingly, the coil base plate can be decreased in thickness. Further, this coil base plate is formed of a non-magnetic material such as aluminum, stainless steel, etc. and thus can be reduced in weight.

Besides, the coil base plate is not attracted by the magnet, and, therefore, a strength of the coil base plate with respect to an attracting force of the magnet can be ignored. From the above-mentioned, the coil base plate can be thinned, resulting in obtaining a light-weight coil base plate. Therefore, the movable unit of the shuttle unit can be reduced in weight. Accordingly, the reciprocating motion of the printing unit can be speeded up.

Further, as illustrated in FIG. 4, since the printing shuttle 2 unit and the balance shuttle unit 12 are structured in such a way that the coil movable units and the magnetic circuits are separated from each other, the coil unit itself does not undergo an influence of the magnet at all. Hence, the coils can be attached and detached when replaced in a maintenance work or the like.

As shown in FIG. 4, in the magnetic circuits of the two shuttle units, i.e., the printing shuttle unit 2 and the balance shuttle unit 12, the block 25 mounted with magnet fitting bases 6, 16 and yoke plates 28-1, 28-2 each bearing a face-to-face relationship therewith is formed in the E-shape. A flatness of the fitting surface thereof can be thereby secured. This makes it possible to uniformize a gap in a linear motor. A more constant speed-up is also attainable.

Further, the movable coil unit has such a box structure that the coil base plate is attached to the connecting arms at both edges of the shuttle frame, and therefore an enhancement of the strength of the shuttle frame can be actualized. The light-weight shuttle frame can be thereby obtained.

In addition, the shuttle frames, the connecting arms and the movable coil units of the two shuttle units are commonized, and, hence, it is possible to decrease costs and improve an assembling property.

In addition to the embodiment discussed above, the present invention can be modified as follows. First, although the holding block assuming the E-shape is employed, the configuration of the holding block is not confined to this shape. Second, the printing unit including the wire dot printing elements has been exemplified, however, the present invention is applicable to printing units having other types of dot printing elements.

The present invention has been discussed so far by way of the embodiment but can be carried out in a variety of modifications within the range of the gist of the present invention. These modifications are not excluded from the scope of the present invention.

As explained above, according to the present invention, the coil movable units and the magnetic circuits of the shuttle units are separated from each other, and hence the coil movable units can be reduced in weight. For this reason, the reciprocating motion of the printing unit can be speeded up. Further, the maintenance work is also facilitated. Moreover, since the printing shuttle unit and the balance shuttle unit are provided up and down, the packaging area can be set compact.

What is claimed is:

1. A dot line printer comprising:

a printing shuttle unit making a reciprocating motion to perform dot printing; and a balance shuttle unit making a motion in a direction opposite to the kinetic direction of said printing shuttle unit, said printing shuttle unit including:

a first magnetic circuit having a first magnet and a first yoke that are disposed in a face-to-face relationship;

a first coil base plate disposed in a magnetic gap of said first magnetic circuit and provided with first coils;

a printing unit having a plurality of dot printing elements;

a printing shuttle frame mounted with said printing unit; and a pair of first connecting arms for connecting said first coil base plate to said printing shuttle frame, said balance shuttle frame including:

a second magnetic circuit having a second magnet and a second yoke that are disposed in the face-to-face relationship;

a second coil base plate disposed in a magnetic gap of said second magnetic circuit and provided with second coils;

a balance unit for taking a balance with said printing unit;

a shuttle frame mounted with said balance unit; and a pair of second connecting arms for connecting said second coil base plate to said shuttle frame.

2. A dot line printer according to claim 1, wherein each of said first and second coil base plates is composed of a non-magnetic material respectively.

3. A dot line printer according to claim 1, wherein said first coil base plate of said shuttle unit, said pair of first connecting arms and said shuttle frame are linked to constitute a box body, and said second coil base plate of said balance shuttle unit, said second connecting arms and said shuttle frame are linked to constitute a box body.

4. A dot line printer according to claim 1, wherein said printing unit includes a plurality of wire dot printing elements.

5. A dot line printer for performing dot printing on a sheet, comprising:

a printing shuttle unit making a reciprocating motion to perform the dot printing; and a balance shuttle unit provided under said printing shuttle unit and making a motion in a direction opposite to the kinetic direction of said printing shuttle unit, wherein said printing shuttle unit includes:

a first magnetic circuit having a first magnet and a first yoke that are disposed in a face-to-face relationship;

a first coil base plate disposed in a magnetic gap of said first magnetic circuit and provided with first coils;

a printing unit having a plurality of dot printing elements;

a printing shuttle frame mounted with said printing unit; and a pair of first connecting arms for connecting said first coil base plate to said printing shuttle frame, and wherein said balance shuttle frame includes:

a second magnetic circuit having a second magnet and a second yoke that are disposed in the face-to-face relationship;

a second coil base plated disposed in a magnetic gap of said second magnetic circuit and provided with second coils;

a balance unit for taking a balance with said printing unit;

a shuttle frame mounted with said balance unit; and a pair of second connecting arms for connecting said second coil base plate to said shuttle frame.

6. A dot line printer according to claim 5, wherein each of said first and second coil base plates is composed of a non-magnetic material respectively.

7. A dot line printer according to claim 5, wherein said first coil base plate of said shuttle unit, said pair of first connecting arms and said shuttle frame are linked to constitute a box body, and said second coil base plate of said balance shuttle unit, said second connecting arms and said shuttle frame are linked to constitute a box body.

8. A dot line printer according to claim 5, further comprising:

a holding block including an upper arm, an intermediate arm disposed to have a fixed gap with respect to said upper arm and a lower arm disposed to have a fixed gap with respect to said intermediate arm, wherein said first yoke is attached to the lower surface of said upper arm, said first magnet is attached to the upper surface of said intermediate arm, said second magnet is attached to the lower surface of said intermediate arm, and said second yoke is attached to the upper surface of said lower arm.

9. A dot line printer according to claim 5, wherein said printing unit has a plurality of wire dot printing elements.

* * * * *